US007288056B1

(12) United States Patent
Whiting

(10) Patent No.: US 7,288,056 B1
(45) Date of Patent: Oct. 30, 2007

(54) METHOD FOR FINDING AND DEVELOPING RHYTHM AND A DEVICE THEREIN

(76) Inventor: Jennifer M. Whiting, 175 Turkey Hill Rd., Florence, MA (US) 01062

( * ) Notice: Subject to any disclaimer, the term of this patent is extended or adjusted under 35 U.S.C. 154(b) by 344 days.

(21) Appl. No.: 10/880,012

(22) Filed: Jun. 30, 2004

Related U.S. Application Data

(60) Provisional application No. 60/483,362, filed on Jun. 30, 2003.

(51) Int. Cl.
*A63B 23/00* (2006.01)

(52) U.S. Cl. ..... 482/148; 84/470

(58) Field of Classification Search ..... 482/148; 434/247, 250; 84/1, 470 R, 470; 382/103
See application file for complete search history.

(56) References Cited

U.S. PATENT DOCUMENTS 4,319,748 A 3/1982 Alter
5,692,996 A * 12/1997 Widerman ..... 482/93
5,694,340 A 12/1997 Kim
5,813,931 A 9/1998 Gormley
6,102,809 A * 8/2000 Nichols ..... 473/227
6,378,367 B1 4/2002 Dilz, Jr.
6,422,978 B2 * 7/2002 Bouvier ..... 482/82
6,540,649 B1 * 4/2003 Niedrich ..... 482/82
6,644,976 B2 * 11/2003 Kullok et al. ..... 434/236

* cited by examiner

*Primary Examiner*—Lori Amerson
(74) *Attorney, Agent, or Firm*—Deborah A. Basile; Karen K. Chadwell

(57) ABSTRACT

A method for identifying and developing body rhythm, comprising having a practitioner move a first hand in a first pattern in a continuous and a repetitive fashion until a first rhythm has been established; move a second hand in a second pattern in a continuous and repetitive fashion until a second rhythm identical to or closely resembling the first rhythm has been established; move the first and second hands simultaneously in a third pattern in a continuous and repetitive fashion until a third rhythm is established; wherein the method improves cardiovascular heath, improves muscle toning, coordination, and flexibility, and further wherein the method assists the practitioner in identifying and developing an individual sense of rhythm. A rhythm-developing device useful in executing the method disclosed herein.

5 Claims, 3 Drawing Sheets

METHOD FOR FINDING AND DEVELOPING RHYTHM AND A DEVICE THEREIN

CROSS REFERENCE TO RELATED APPLICATIONS

This application claims the benefit of U.S. Provisional Application No. 60/483,362 filed on Jun. 30, 2003.

BACKGROUND OF THE INVENTION

1. Field of the Invention

Disclosed herein is a method for determining and developing a practitioner's sense of rhythm, wherein such method enhances the practitioner's ability to perform in athletic events. Further disclosed herein is a device for performing the method.

2. Background of the Invention

Contemporary society places a high value on obtaining optimal physical fitness. Obvious ways of enhancing one's physical fitness is through the participation in exercise programs and amateur athletics. A problem with these approaches, however, is that they are not well suited for all ages and levels of ability. Furthermore, these approaches may not be available to large portions of the population. Therefore, what is needed is a simple and easy approach to obtaining physical fitness that is accessible to a large segment of the population. Additionally, with an ever-increasing interest in amateur athletics, what is needed is a method for improving athletic proficiency.

SUMMARY OF THE INVENTION

The above-discussed and other drawbacks and deficiencies of the prior art are overcome or alleviated by a method for identifying and developing body rhythm, comprising having a practitioner move a first hand in a first pattern in a continuous and a repetitive fashion until a first rhythm has been established; move a second hand in a second pattern in a continuous and repetitive fashion until a second rhythm identical to or closely resembling the first rhythm has been established; move the first and second hands simultaneously in a third pattern in a continuous and repetitive fashion until a third rhythm is established; wherein the method improves cardiovascular heath, improves muscle toning, coordination, and flexibility, and further wherein the method assists the practitioner in identifying and developing an individual sense of rhythm. Further disclosed herein is a rhythm-developing device useful in executing the method disclosed herein.

DETAILED DESCRIPTION OF THE INVENTION

Figure 1:
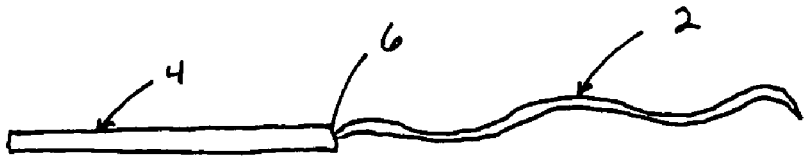
FIG. 1 is a schematic of an exemplary rhythm-developing device.

In general, disclosed herein is a method for determining and developing a practitioner's natural body rhythm. More specifically disclosed herein is a method for developing and enhancing a practitioner's sense of individual rhythm, wherein such rhythm is essential to the proficient engagement in athletic activities. The practitioner's developed rhythm facilitates the learning process for walking, running, throwing, jumping, shooting, striking, swinging, etc, wherein such processes are useful in a wide range of sports activities. In addition to its benefit in creating skills essential for proficient sportsmanship, the method is also useful for purposes of fitness and therapy, and is well adapted for use by a wide range of persons of varying ages and physical abilities.

The method for developing a practitioner's individual body rhythm comprises moving the practitioner's first hand, preferably the dominant hand, in a continuous and repeated pattern. Once the practitioner has acquired a sense of rhythm, as determined by a comfortable, flowing, and steady motion and pace, the practitioner preferably repeats the pattern using the other hand in a continuous fashion until a rhythm comparable to that obtained using the first hand is achieved. In a coordinated fashion, the practitioner then repeats the motion using both hands simultaneously. By following these steps, the practitioner will have learned a coordinated rhythmic motion that will have beneficial cardiovascular effects, and improve muscle tone, coordination and flexibility.

In an exemplary first pattern of motion, the practitioner moves his first hand in a pattern closely resembling the symbol for infinite, ∞. Preferably, by raising the first hand in space at a point representing the center point of the ∞ symbol, i.e., at the point where the two circles of the symbol are joined, the first hand is preferably moved in a clockwise direction until a first circular motion is completed. Upon completing the first circular motion, the first hand then moves in a counterclockwise direction to complete a second circular motion. Alternatively, the practitioner may start at a center point in space representing the center point of the ∞ symbol, move the first hand in a counterclockwise direction until a first circular motion is completed, and then move the first hand in a clockwise direction to complete the second circular motion. Whether the practitioner chooses the first or the alternative path of motion, preferably the same directional motion is repeated in a continuous fashion. As this pattern is repeated over time a practitioner will begin to discover his individual rhythm for the first hand.

Once this rhythm has been established, the practitioner may then practice developing the rhythm with the other hand by using the same pattern of motion as described above until a comfortable, flowing, and steady motion and pace are established. The second hand may move according to the first pattern of motion or according to the alternative pattern of motion. In a particularly preferred embodiment, the practitioner selects the same pattern of motion for both hands. Therefore, if the first hand moves according to the first pattern of motion described above, then preferably, the second hand also moves according to the first pattern of motion.

Once the practitioner has accomplished a smooth, continuous, and regular ∞-patterned movement with each hand, the practitioner then preferably uses both hands to create the ∞ patterned motion in a simultaneous fashion. Although the first hand may move in one type of motion as described above and the second hand may move in the alternative direction, it is preferred that both hands move in the same direction, and that both hands start at a point representative of the center point at the same time. Preferably, both hands continue to move until a two-sided rhythmic coordination is achieved.

Upon continuous repetition of this simultaneous movement of both hands, the practitioner's understanding of his individual rhythm will be discovered. Over time this rhythm will become instinctual and will assist the practitioner in applying this rhythm over a broad range of movements that will assist the practitioner in walking, running, throwing, jumping, shooting, striking, swinging, etc.

In order to further assist the practitioner in discovering and refining his individual rhythm, the method contemplates utilizing a rhythm-developing device. The rhythm-developing device comprises a flowable element attached to a tool. The tool may comprise any implement that may be held by the hand, preferably in the palm of the hand, and that is sufficiently lightweight such that a practitioner may readily move the rhythm-developing device in a continuous and repeated fashion.

In an exemplary embodiment the tool comprises a solid or hollow stick, wherein the stick comprises wood or plastic, wherein wooden sticks are especially preferred. The stick may comprise a wide variety of sizes, wherein a length of about 4 inches to about 24 inches is preferred, a length of about 8 to about 16 inches is more preferred, and a length of about 12 inches is especially preferred.

In other exemplary embodiments, the tool comprises a tennis racket, a baseball bat, a golf club, a racing baton, a gymnastics baton, a club, a ball, and the like, wherein the ball may comprise a tennis ball, a baseball, a softball, a volleyball, a basketball, a golf ball, and the like. In these embodiments, the tool may be conventional or may be modified to further enhance the use of the rhythm-developing device.

The flowable element comprises any material that has a flexible, fluid motion when moved in a pattern such as is described herein. Preferably, the flowable element comprises a ribbon, a streamer, a string, and the like, wherein a satin or a satin-like ribbon is especially preferred. Additionally, the flowable element preferably comprises geometric dimensions sufficient to allow the practitioner to observe the pattern of the flowable element when the rhythm-developing device is in use while minimizing the gravitational effects on the flowable element. In an exemplary embodiment, the flowable element comprises a length of about 0.5 foot to about 20 feet, wherein a length of about 3 feet to about 12 feet is more preferred, and a length of about 5 feet to about 9 feet is especially preferred, with about 7 feet most preferred. The flowable element preferably comprises a width of about 0.25 inch to about 6 inches, with about 1.25 inches to about 4 inches more preferred, with about 2.0 inches especially preferred.

The flowable element may be permanently or detachably attached to the tool by a wide variety of fastening elements. Such fastening elements may comprise, for example, a nail; a screw; a staple; an eye screw; an adhesive, such as glue, tape, etc.; fastening hooks; and the like; and combinations comprising at least one of the foregoing.

FIG. 1 depicts an exemplary embodiment of a rhythm-developing device suitable for the method disclosed above. According to FIG. 1, a rhythm-developing device comprises a ribbon 2 attached to an end 6 of a stick 4.

By moving the rhythm-developing device according to the method disclosed above, a practitioner may study the flow of the ribbon. Such study will trace the pattern of the ribbon's motion which will assist the practitioner in determining his rhythm. As the ribbon reflects the motion of the practitioner's hand(s), any changes in the position of the hands during execution of the pattern, or any change in the pace of the motion will be reflected in the flowable element's motion. Therefore, by watching the flowable element as it moves in response to the practitioner's hand motion, the practitioner is able to visualize his rhythm and any changes therein. The practitioner can determine the ideal rhythm by what feels comfortable and smooth and by watching the fluid motion of the flowable element.

It is further contemplated that the method disclosed herein may be accompanied by music. That is, by listening to music while performing the method described above, the practitioner's ability to detect his natural body rhythm and to improve upon the rhythm is enhanced.

Once a practitioner has developed his natural body rhythm, he may more readily learn additional motions that will improve his proficiency in such tasks, including, but not limited to, walking, running, throwing, jumping, dancing, shooting, striking, swinging, fishing, martial arts, e.g., the use of bows and swords, and the like. These movements will improve upon the practitioner's athletic abilities. For example, a practitioner may more readily learn how to proficiently swing a bat, swing a tennis racket, swing a golf club, etc. Therefore, the method disclosed above, wherein a practitioner is assisted in determining and refining his individual body rhythm, may be expanded to further include developing a rhythm for engaging in a multitude of athletics.

The additional pattern of motion comprises posturing and moving one's body in a manner consistent with that for a particular type of athletic move. For example, when learning how to enhance one's running stride, a practitioner may use one or more of the rhythm-developing devices depicted in FIG. 1 while running. Such a rhythm-developing device may comprise a track baton with a flowable element attached to it.

Figure 2:
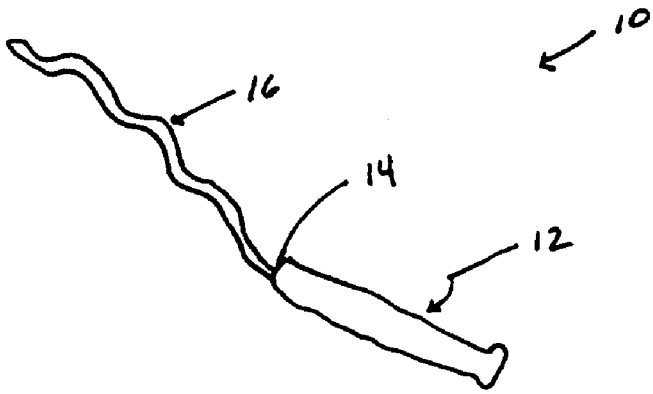
FIG. 2 is a schematic of another exemplary rhythm-developing device.

Additionally, when learning how to develop a swing of a baseball bat, the practitioner can assume the stance of a hitter and swing the bat in a motion typical of a baseball hitter. While performing the motion, the practitioner preferably utilizes the rhythm-developing device, an exemplary embodiment of which is shown in FIG. 2. As shown in FIG. 2, a rhythm-developing device 10 comprises a bat 12 having an end 14 upon which a ribbon 16 is attached.

Figure 3:
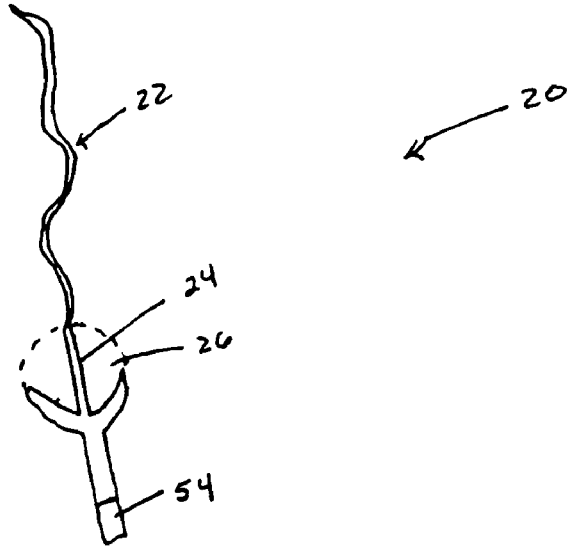
FIG. 3 is a schematic of another exemplary rhythm-developing device.
Figure 4:
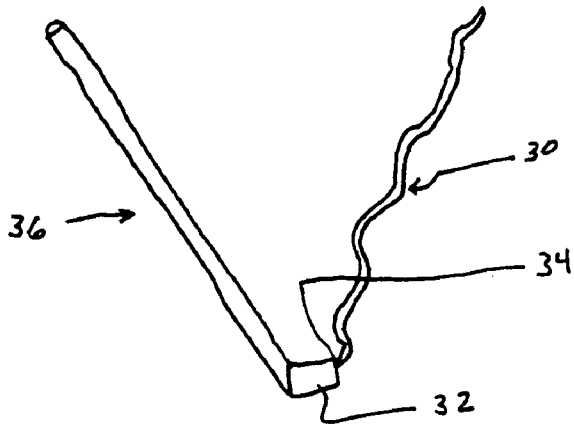
FIG. 4 is a schematic of another exemplary rhythm-developing device.
Figure 6:
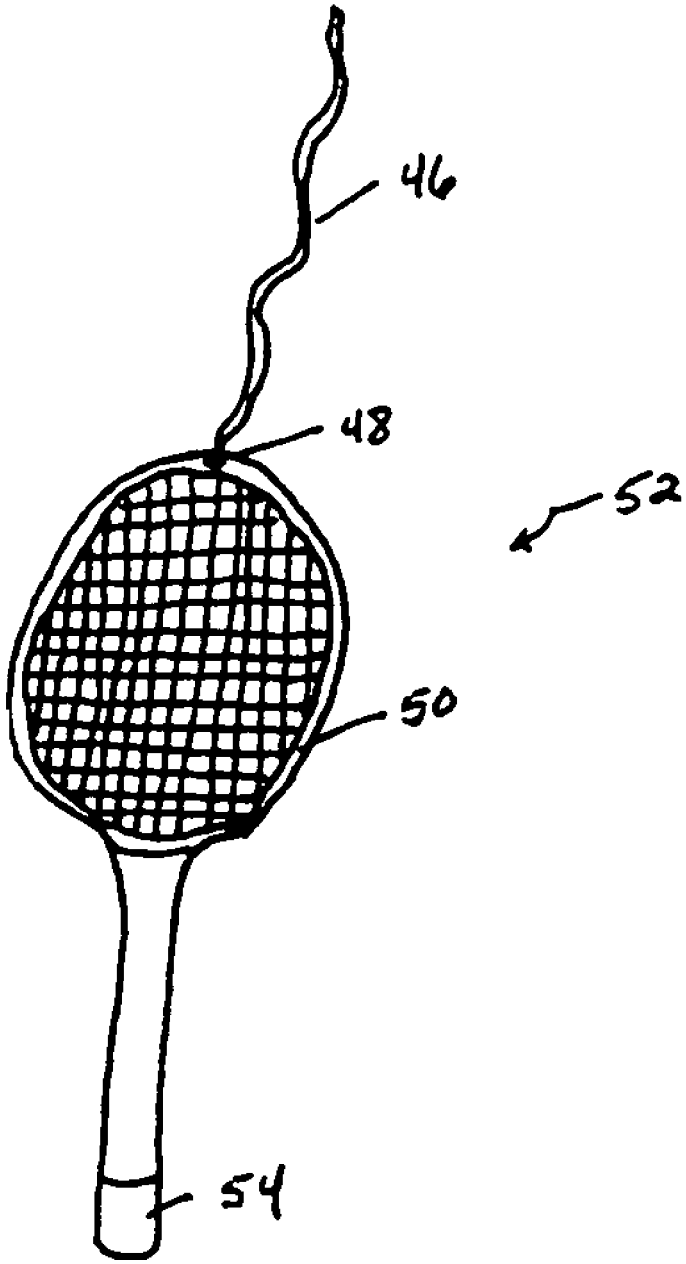
FIG. 6 is a schematic of another exemplary rhythm-developing device.

Similarly, FIGS. 3, 4, and 6 depict rhythm-developing devices suitable for use in tennis (FIGS. 3 and 6) and in golf (FIG. 4). Referring to FIG. 3, a tennis racket 20 is adapted to fit a ribbon 22 onto a midline frame 24 of a head 26. Referring to FIG. 6, a ribbon 46 is secured to a central outer tip 48 of a frame 50 of a standard tennis racket 52. In either embodiment depicted in FIGS. 3 and 6, an end portion 54 of the tennis rackets may be weighted. Referring to FIG. 4, a ribbon 30 is attached to an end portion 34 of a head 32 of a golf club 36.

Figure 5:
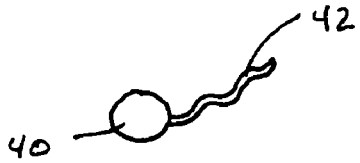
FIG. 5 is a schematic of another exemplary rhythm-developing device.

Furthermore, as shown in FIG. 5, the rhythm-developing device may comprise a ball 40 comprising a ribbon 42, wherein such a device is useful in determining the effect of a hit, a push, a throw, a toss, or any other like force.

By watching the ribbon the practitioner will be assisted in visualizing the flow of his body movement and the effect of his body movement. This will assist the practitioner in developing a flow and an effect that maximizes the practitioner's potential at a particular physical task.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method, comprising a practitioner:

moving a first hand in a first pattern in a continuous and a repetitive fashion until a first rhythm has been established;

moving a second hand in a second pattern in a continuous and repetitive fashion until a second rhythm identical to or closely resembling the first rhythm has been established;

moving the first and second hands simultaneously in a third pattern in a continuous and repetitive fashion until a third rhythm is established; and executing an additional pattern of motion, wherein the additional pattern of motion establishes a proper movement for the improved performance of an activity, wherein the activity comprises tennis, wherein the practitioner utilizes a rhythm-developing device in executing the additional pattern of motion, wherein the rhythm-developing device comprises a flowable element attached to a tool;

wherein the method improves cardiovascular heath, improves muscle toning, coordination, and flexibility, and further wherein the method assists the practitioner in identifying and developing an individual sense of rhythm.

2. The method of claim 1, wherein executing the additional pattern of motion comprises executing a standard tennis move, and wherein the method further comprises studying the motion of the flowable element in response to the standard tennis move.

3. The method of claim 1, wherein the rhythm-developing device comprises a tool comprising: a handle joined to a head, wherein the head comprises netting surrounded by a frame, and wherein the frame comprises a central outer tip; and further wherein the flowable element is secured to the central outer tip.

4. The method of claim 3, wherein the handle is weighted.

5. The method of claim 1, wherein the rhythm-developing device comprises:

a tool comprising:

a racket comprising:

a frame, wherein the frame comprises:

a first lateral side having a top end and a bottom end;

a second lateral side having a top end and a bottom end; and a midline having a top end and a bottom end, wherein the midline is between the first and second lateral sides;

wherein the bottom ends of the first lateral side, the second lateral side, and the midline are joined; and a handle having a top end opposite to a bottom end, wherein the top end is joined to the frame; and a flowable element attached to the top end of the midline.

* * * * *